US005797636A

United States Patent [19]

Hämynen

[11] Patent Number: 5,797,636

[45] Date of Patent: Aug. 25, 1998

[54] DISPOSABLE PET EXCREMENT COLLECTION DEVICE

[76] Inventor: Jari Hämynen, Korppaanmäentie 11 B 16, Helsinki, Finland, 00300

[21] Appl. No.: 628,623

[22] PCT Filed: Oct. 11, 1994

[86] PCT No.: PCT/FI94/00458

§ 371 Date: Jun. 24, 1996

§ 102(e) Date: Jun. 24, 1996

[87] PCT Pub. No.: WO95/10666

PCT Pub. Date: Apr. 20, 1995

[30] Foreign Application Priority Data

Oct. 11, 1993 [FI] Finland ..... 930501

[51] Int. Cl.[6] ..... A01K 29/00; E01H 1/12

[52] U.S. Cl. ..... 294/1.3; 15/257.6; 294/55

[58] Field of Search ..... 294/1.1, 1.3, 1.4, 294/25, 55; 15/104.8, 257.1, 257.6; 141/108, 331, 337, 391; 229/115, 116; 383/71, 72, 74, 84

[56] References Cited

U.S. PATENT DOCUMENTS

| | | | |
|---|---|---|---|
| 2,749,695 | 6/1956 | Hoopingarner | 294/1.1 X |
| 3,052,214 | 9/1962 | Johnson | 294/1.4 |
| 3,830,423 | 8/1974 | Prescott | 294/1.3 |
| 3,885,266 | 5/1975 | Nafziger | 294/1.3 |
| 3,971,503 | 7/1976 | Allan et al. | 294/1.3 |
| 3,977,422 | 8/1976 | Cabaluna | 294/1.4 |
| 4,830,419 | 5/1989 | Watanabe | 294/1.3 |

FOREIGN PATENT DOCUMENTS

| | | | |
|---|---|---|---|
| 3326305 | 8/1984 | Germany | 294/1.3 |
| 4011018 | 8/1991 | Germany | 294/1.3 |

*Primary Examiner*—Johnny D. Cherry
*Attorney, Agent, or Firm*—Cohen, Pontani, Lieberman & Pavane

[57] ABSTRACT

A disposable pet excrement collection device comprises a mantle piece with a broad-mouth opening and an inner space to receive collected pet excrement. The mantle piece converges at its opposite end to form a closed tip. The mantle piece is foldable from a flat storage configuration to a funnel-shaped configuration ready for use. The collection device includes at least one shutter at the broadmouth opening and a pull cord attached to the shutter. The pull cord is routed through the closed tip and, when the end of the pull cord that is routed through the closed tip is pulled, the shutter closes to thereby containing the excrement that has been collected.

10 Claims, 3 Drawing Sheets

DISPOSABLE PET EXCREMENT COLLECTION DEVICE

The invention relates to a collection device for loose material, preferably excrement. The invention relates particularly to immediate collection of dogs excrement by a disposable collection device. With the device excrement can be collected and packed from a place requiring common tidiness, such as passageways, yards and parks.

The collection of dogs excrement has during years been tried to solve by various devices. The most common collection devices comprise a small plastic bag to protect the hand, whereby the bag after collection of excrement is turned around and closed. A plastic glove has a similar operational principle. A paper bag, into which excrement is lifted by a small plastic shovel, has sometimes been used regardless of the transportation problems of the soiled shovel. There are also collection devices more rarely used, such as a device provided with a metal handle and to which a plastic bag can be set. Special collection bags and assembly boxes are also known equipped with a separate plate to push the excrement in, and a stick, the lower end of which has a box or plastic bag. The use of such devices for collection of excrement is however rather insignificant in spite of the continuously growing number of dogs. In cities and densely populated areas the master neglects the collection of his dog's excrement regardless of people's glances of re-proof The inability/unwillingness of the masters to solve the excretion problem may partly arise from the fact, that a practical and reasonably-priced excrement collection device has not been available.

The object of the present invention is to solve the problems connected with the excrement collection and to provide a novel excrement collection device, which is hygienic, easy to use and enables immediate collection of excrement without any unpleasant feeling.

This object will be obtained by the excrement collection device described above, the features of which are presented in the enclosed claims.

Advantages of the invention are derived from the fact that the excrement collection device is small in size, flat, and easily portable, that the collection device although flat in its basic condition, can be pressed into a rigid collection funnel shape, and that the collection device has a pulling means making possible a turning of the shutters in the device without touching them by hand to close the mouth opening such that excrement can be hygienically and conveniently packed.

The invention will be described in the following as an example embodiment with reference to the following drawings, in which.

Figure 1:
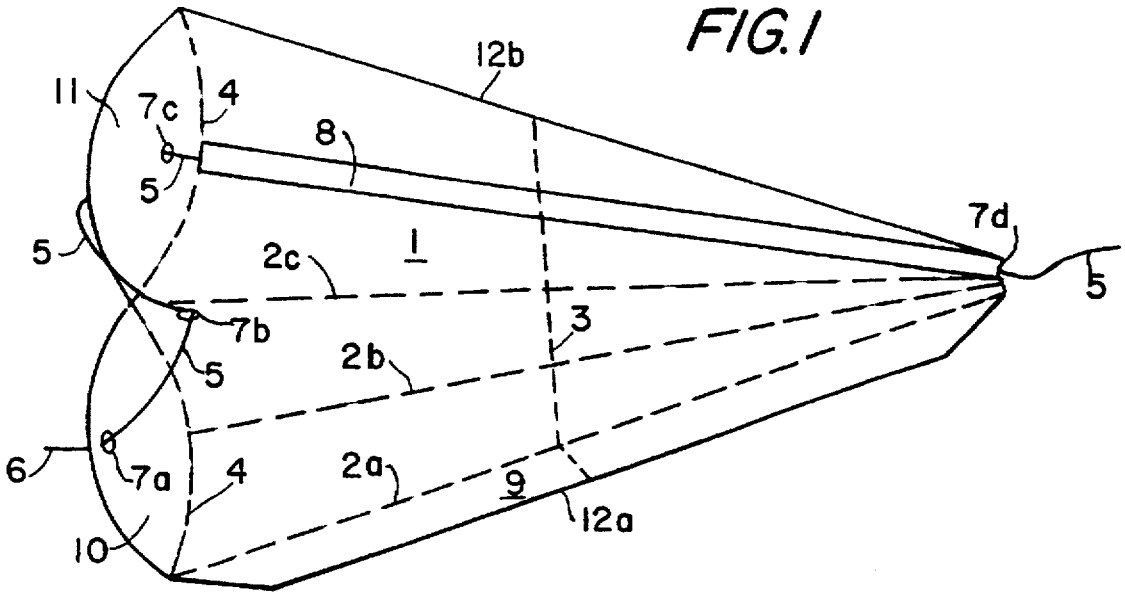
FIG. 1 shows as an inside view of the excrement collection device according to the invention in the spread-out condition.

With reference to FIGS. 1–4 the excrement collection device according the first advantageous embodiment of the present invention is described. The collection device comprises a carton cut into a wedge like shape or corresponding material element. In this embodiment the broader end of the element has been formed as two arches with essentially the same form and size. Concave arch folds 4 have also been formed to the element mainly as mirror images of the arches. Concave folds and convex arches begin and end at the same points, and they additionally define the shutters 10 and 11 folding to the element.

In order to make the funnel-shaped excrement collection device of the above-mentioned element, this element has at least one pair of straight fold lines 2*a*, 2*c*; 2*b*, 2*d*. The fold lines 2*a*, 2*c*; 2*b*, 2*d* radially are equally spaced from each other, and separate from the element end towards the shutters. One longitudinal edge 12*a* of the element has an adhesive strip or surface 9. The narrow point of the wedge like element has been formed so, that when the element is folded along the centre fold line 2*c* a small aperture 7*d* is formed to it. The element double-folded along the centre fold line 2*c* is formed into a funnel shape by folding the protruding or console formed edge 12*a* over the other element edge, whereat it forms a uniting and reinforcing seam. The collection device thus obtained can be folded along the transversal fold line 3 once again into a storing condition, in which it can easily be inserted into a pocket.

As already mentioned above two shutters are used, one of which is the upper shutter 10 and the other The lower shutter 11. Near the upper shutter 10 beside the centre fold 2*c* there is an aperture 7*b*. Each shutter arrangement has also apertures 7*a* and 7*b* in the upper shutter 10 near the centre part of the curved edge and in the lower shutter 11 near the centre part of the curved fold line 4.

A pulling means 5 used to close the shutters 10 and 11 is selected from a group comprising: wire, strip, glue thread or similar means. At the beginning of the pulling means 5 there is a knot 6. The pulling means 5 is threaded through the aperture 7*a* from outside the upper shutter inside the device 1 and out through the aperture 7*b* close to the centre fold 2*c*. The pulling means 5 returns through the same aperture 7*b* inside the device leaving a small loop outside the device. Thereafter the pulling means 5 goes around the edge of the lower shutter outside the device and through the aperture 7*c* again inside the device 1, whereafter the pulling wire goes advantageously under a dust cover 8 towards the aperture 7*d* at the tip of the device, through which the end of the pulling means 5 comes out again.

Figure 5:
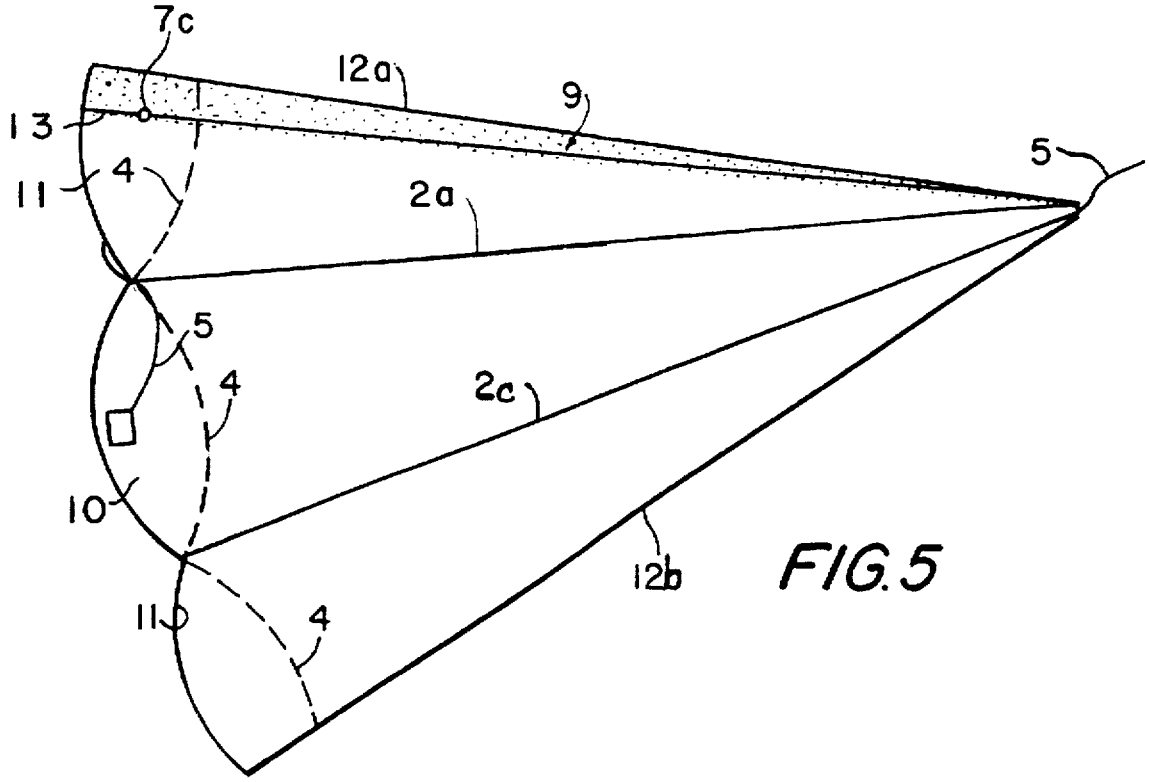
FIG. 5 shows an inside view of another embodiment of the excrement collection device according to the invention in the spread-out condition.
Figure 6:
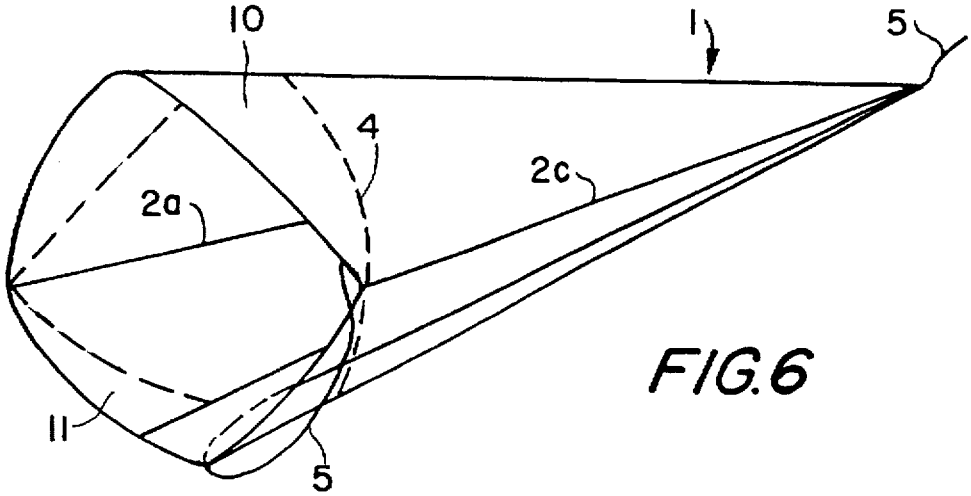
FIG. 6 shows the excrement collection device according to the FIG. 5 embodiment ready for use.

Referring to FIGS. 5 and 6 the excrement collection device according to the second embodiment of the invention will be described. The collection device 1 is composed of a carton cut into a wedge like shape or corresponding material element. In this embodiment the broader end of the element has one arch in the middle and symmetrically shorter arches on both sides. Additional arch folds 4 mainly in compliance with mirror images of the arches have also been formed to the element. Concave folds and convex arches begin and end at the same points.

In order to make a funnel-shaped excrement connection device from the above-mentioned element, the element has two straight fold lines 2*a* and 2*c* extending radially and equally spaced from each other and separating from the element end towards the shutter, whereby one longitudinal edge 12*a* of the element has an adhesive 9 surface. The double-folded element is glued as a funnel, when the longitudinal 9 edge 12*a* is pressed tightly against the other edge of the element. The collection device thus obtained can be folded once again e.g. along the transversal fold line shown in FIGS. 1–4 into a storage condition, in which it can conveniently be inserted into the pocket.

Figure 2:
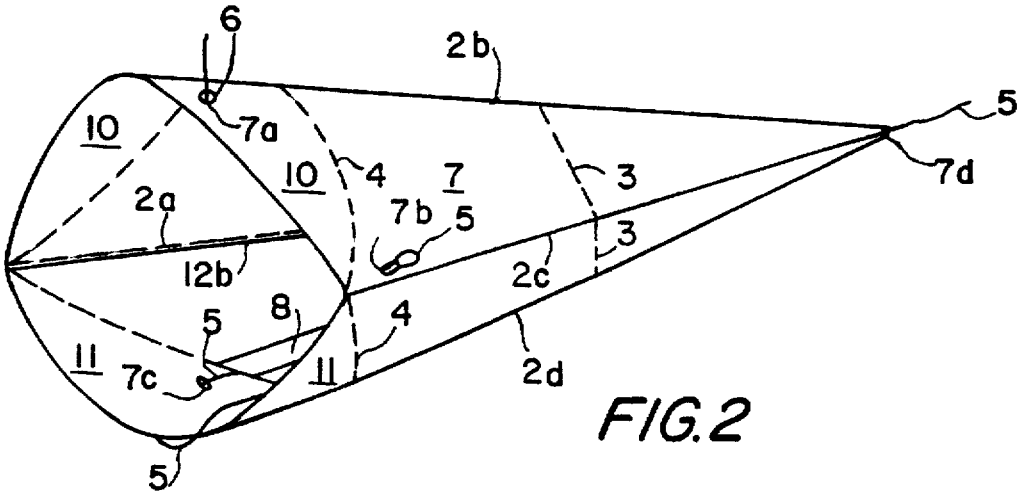
FIG. 2 shows as an oblique forward view of the excrement collection device according to the invention, the mouth opening being pressed open, i.e. ready for use.
Figure 3:
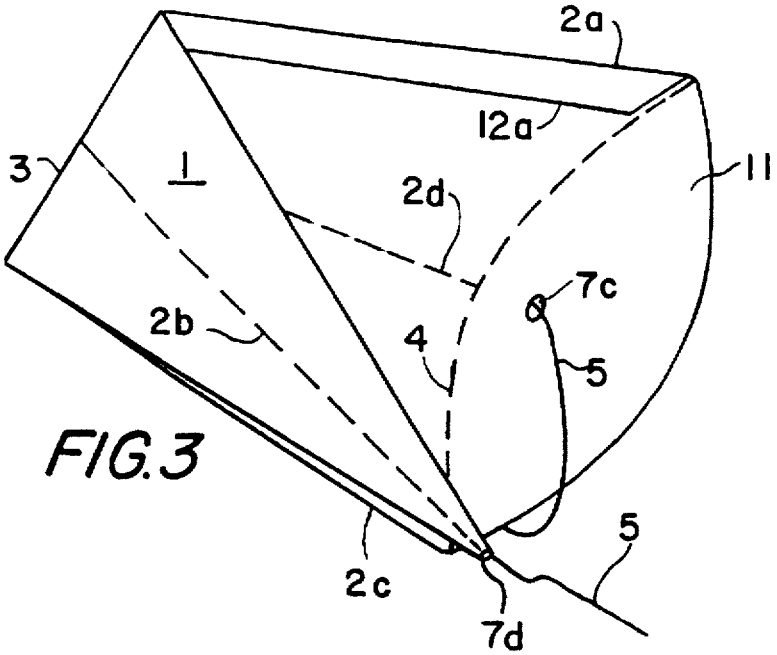
FIG. 3 shows the excrement collection device according to the invention in a folded condition, e.g. for transportation in the pocket.
Figure 4:
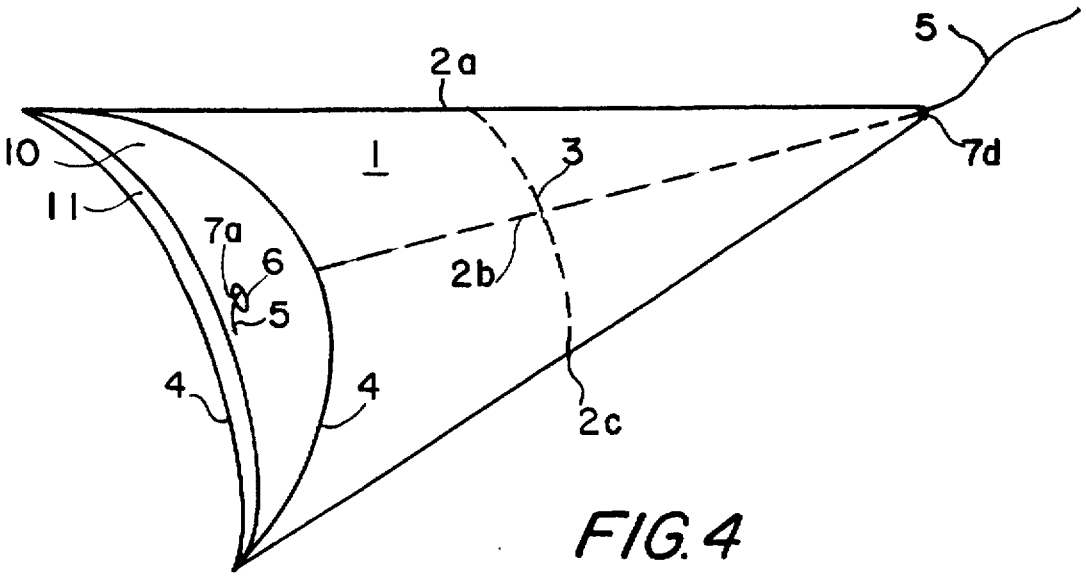
FIG. 4 shows the excrement collection device according to the invention after the use when the mouth opening is closed, i.e. the excrement being packed.

As already mentioned above, there are two shutters, one of which comprises a uniform upper shutter 10 and the other a two-piece lower shutter 11 with a double centre part. The other part forming the lower shutter has a slash 13 (or aperture 7*c* as shown in FIGS. 1–3).

The pulling means 5 used to close the shutters 10 and 11 is selected from a group comprising: wire, strip, glue thread or similar. The beginning of the pulling means 5 has been fixed by a tie or a corresponding knot to the inner surface-of the upper shutter 10 close to the centre of the curved edge of the upper shutter (alternatively it is possible to use a pulling means 5 having a knot at its end and being threaded through the aperture according to FIGS. 1–4 from outside to inside). From there it goes from inside to outside over the edge of the mouth opening of the mantle piece and further on through the slash 13 or aperture 7*c* of the slashed or apertured shutter part situating near the outermost part of the shutter, in relation to the end of the mantle piece and again inside the device. The pulling means 5 then goes between the element edges glued one upon the other to the tip of the device, where the end of the pulling means 5 comes out again.

The collection device according to the invention operates as follows. The flat configuration of the collection device is converted into funnel shape by pressing it lightly at the edges or at the straight fold lines 2*a* and 2*c*. By the funnel-shaped mantle, piece the excrement laying on the ground is carefully "scooped" and lifted. Due to the configuration of the collection device, the converging mantle piece functions as a natural handle and a sufficient distance can be maintained between a user's hand and the excrement to be collected, so that the unpleasant feeling connected with the handling of the excrement will be avoided. Upon collection, the range of the contact area to the ground is regulated by the loading of the lower shutter 11, whereby the contact area can be changed from narrow to broad or vice versa only by alteration of the loading, which enables the collection of both soft and hard excrement. When excrement has been collected in through the mouth opening, the mantle piece is lifted up, whereby the excrement goes downwards in the funnel. Thereafter the pulling means 5 visible at the end of the mantle piece is drawn freely by hand so that it first is tightened and either discharged laterally from the holding aperture 7*b* or is detached from the inner surface of the mantle piece and begins then to move downwards outside the lower shutter 11 over it straightly across the mouth opening to the upper shutter When the pulling means 5 is tightened further on, the lower shutter 11 begins first to turn to form a barrier for the mouth opening followed by the upper shutter 10 that begins to turn over the lower shutter 11. Thus also the lower shutter that may be soiled upon collection of the excrement remains hidden under the clean upper shutter 10. It is recommendable to apply friction material or adhesive on the dust cover 8 or between the edges 12*a* and 12*b* glued together to lock the pulling wire and to prevent in this way the retraction of the pulling means 5 and inadvertent opening of the shutters.

The invention has been described above only as an example. To the person familiar in the field it is obvious that changes and/or modifications can be made to the invention without departing from the inventive idea defined in the enclosed claims

I claim:

1. A collection device for loose material, comprising:

a mantle piece foldable to a substantially funnel-shaped form having a broadmouthed open end, an inner space to receive loose material being collected and a closed tip at an end of the mantle piece opposite said broadmouthed open end;

said mantle piece being collapsible into a flat storage form and expandable from said flat storage form to said funnel-shaped form for use;

said mantle piece comprising a foldable shutter hingedly connected at the open end for movement from an open position allowing ingress of the loose material into said inner space through said opening and a closed position preventing egress of loose material from the inner space through said opening; and an elongated cord having one end connected to said foldable shutter and an other end operatively positioned in said mantle piece for operatively moving said foldable shutter to said closed position when the other end of said cord is operatively pulled by a user.

2. The collection device of claim 1, wherein said mantle piece comprises two substantially symmetrical halves joined at a fold line and opposed side edges on said halves remote from said fold line, and a tab depending from one of said side edges for engagement with the other of said side edges to form said funnel shaped mantle piece; and said foldable shutter comprising a shutter hingedly connected to each of said symmetrical halves at said open end.

3. The collection device of claim 2, wherein said shutters are connected to said symmetrical halves along curved fold lines at said open end and said shutters are symmetrically aligned.

4. The collection device of claim 1, wherein said mantle piece comprises a sheet of material divided into three sections by straight fold lines; said three sections comprising a middle section forming one half of said funnel-shaped mantle piece; and two outer sections, each connected at a fold line to said middle section and fixedly connected to each other, forming an other half of said funnel-shaped mantle piece; and said foldable shutter comprising a first foldable shutter hingedly connected to said middle section and a shutter piece connected to each of said outer sections, said two connected outer sections forming a second foldable shutter from said shutter pieces.

5. The collection device of claim 1, wherein said foldable shutter comprises two shutter parts that together form said foldable shutter.

6. The collection device of claim 1, wherein said hinged connection between said foldable shutter and said mantle piece is convexly curved relative to said closed tip for operatively maintaining said closed position of said shutter.

7. The collection device of claim 1, wherein said cord comprises one of a wire, strip, glue thread, yarn, and string and said cord is threaded through said foldable shutter and through a hole defined in said mantle piece and extending from said inner space to an exterior of said collection device so that when said other end of the cord is pulled away from said collection device, said foldable shutter is moved to said closed position.

8. The collection device of claim 1, wherein said foldable shutter comprises two shutters hingedly connected at said open end of said mantle piece;

said one end of said cord being fixedly connected to a first of said two shutters;

said other end of said cord being threaded through a first aperture defined in a second of said two shutters from an outer side of said second shutter to an inner side of said second shutter, and said cord being threaded through a second aperture defined at said closed tip of said mantle piece; and a section of said cord between said first and second shutters being operatively retained proximate a peripheral boundary wall of said inner space for preventing said section of the cord from obstructing ingress of loose material into said inner space.

9. The collection device of claim 8, wherein said cord is threaded through a sleeve between said open end and said closed tip, wherein said sleeve comprises one of a strip used for connecting one side to another side of said mantle piece to form said funnel-shaped form and a separate strip of material connected to the peripheral boundary wall of said inner space.

10. The collection device of claim 8, wherein said second of said two shutters operatively moves to said closed position before said first of said two shutters when said cord is pulled.

* * * * *